US006135733A

United States Patent [19]

Wu

[11] Patent Number: 6,135,733

[45] Date of Patent: Oct. 24, 2000

[54] MANUAL AIR PUMP HAVING SELECTABLE HIGH PRESSURE AND LOW PRESSURE MODES

[76] Inventor: Scott Wu, P.O. Box 63-247, Taichung, Taiwan

[21] Appl. No.: 09/499,138

[22] Filed: Feb. 7, 2000

[51] Int. Cl.[7] ..... F04B 19/02

[52] U.S. Cl. ..... 417/467; 417/469; 417/487; 417/521

[58] Field of Search ..... 417/467, 460, 417/468, 487, 521, 544, 570

[56] References Cited

U.S. PATENT DOCUMENTS

| | | | |
|---|---|---|---|
| 1,381,115 | 6/1921 | Gassenhuber, Jr. | 417/467 |
| 1,424,928 | 8/1922 | McClelland | 417/467 |
| 5,443,370 | 8/1995 | Wang | 417/238 |
| 5,779,457 | 7/1998 | Chuang et al. | 417/467 |
| 6,027,316 | 2/2000 | Wang | 417/307 |

*Primary Examiner*—Charles G. Freay
*Assistant Examiner*—Robert Z. Evora
*Attorney, Agent, or Firm*—Alan Kamrath; Oppenheimer Wolff & Donnelly, LLP

[57] ABSTRACT

A manual air pump includes a cylinder having a first chamber and a head provided to the second end of the cylinder. The head includes an outlet passage communicated with the first chamber for supplying air to an object to be inflated. A first piston rod has a first end with a first piston slidably received in the first chamber. The first piston separates the first chamber into a first chamber section adjacent to the head and a second chamber section distal to the head. The first piston rod defines a second chamber therein. A second piston rod has a first end with a second piston slidably received in the second chamber. The second piston separates the second chamber into a third chamber section adjacent to the first piston and a fourth chamber section distal to the first piston. A handle is secured to the second end of the second piston rod to move therewith. Reciprocating movement of the handle causes high volume/low pressure inflation when the handle is engaged with the first piston rod to allow joint sliding movement of the first piston rod and the second piston rod. Reciprocating movement of the handle causes low volume/high pressure inflation when the handle is disengaged from the first piston rod and the first piston rod is retained in the second end of the first chamber.

11 Claims, 5 Drawing Sheets

MANUAL AIR PUMP HAVING SELECTABLE HIGH PRESSURE AND LOW PRESSURE MODES

BACKGROUND OF THE INVENTION

1. Field of the Invention

The present invention relates to a manual air pump for inflating, e.g., bicycle tires, and more particularly to dual-mode manual air pump that may in one mode provide a very high volume of air per stroke and in another mode provide less volume of air at high pressure.

2. Description of the Related Art

Bicycle pumps include two typical types: 1) big bore for high volume per stroke and low pressure for rapid inflation, yet high pressure operation is difficult to achieve; and 2) small bore for low volume per stroke and high pressure for inflating bicycle tires to high pressure. U.S. Pat. No. 5,443,370 issued to Wang on Aug. 22, 1995 proposes a two-cylinder manual air pump having selectable high volume and high pressure modes, wherein the pump in one mode provides a very high volume of air per pump stroke and in another mode provides less volume per stroke but enables the user to inflate to higher pressures. Nevertheless, manufacture, assembly, and use of such manual air pump are complicated and troublesome. The structure in the cylinders for air passage is too complicated. In addition, the thinner piston rod might be broken during the output stroke, as the travel for the thinner piston rod is relatively long and the piston on the thinner piston rod encounters much higher pressure when the piston approaches the inner end of the outer cylinder. Namely, such a thinner piston rod tends to be broken and requires a larger force to push it.

SUMMARY OF THE INVENTION

A manual air pump in accordance with the present invention comprises:

- a cylinder comprising a first chamber and including a first end and a second end,
- a head provided to the second end of the cylinder, the head including an outlet passage communicated with the first chamber for supplying air to an object to be inflated,
- a piston assembly including:
  - a first piston rod having a first end with a first piston slidably received in the first chamber and a second end, the first piston separating the first chamber into a first chamber section adjacent to the head and a second chamber section distal to the head, the first piston rod defining a second chamber therein,
  - a second piston rod having a first end with a second piston slidably received in the second chamber and a second end, the second piston separating the second chamber into a third chamber section adjacent to the first piston and a fourth chamber section distal to the first piston, and
  - a handle secured to the second end of the second piston rod to move therewith,
- means for supplying ambient air into one of the second chamber section and the fourth chamber section during an outward stroke of the handle away from the head,
- means for releasably engaging the handle with the first piston rod;
- means for communicating the third chamber section with the outlet passage when the first piston rod is retained in the second end of the first chamber;
- whereby reciprocating movement of the handle causes high volume/low pressure inflation when the engaging means engage the handle with the first piston rod to allow joint sliding movement of the first piston rod and the second piston rod, and reciprocating movement of the handle causes low volume/high pressure inflation when the handle is disengaged from the first piston rod and the first piston rod is retained in the second end of the first chamber.

The first end of the cylinder includes an end cap mounted thereto. The end cap includes an opening through which the first piston rod extends. An air inlet is defined in the end cap for supplying ambient air into the second chamber section during an outward stroke of the handle away from the head for high volume/low pressure inflation. In an embodiment of the invention, the opening of the end cap includes an inner threading and the second end of the second piston rod includes an outer threading for releasably engaging with the inner threading of the end cap for low volume/high pressure inflation.

The first end of the second piston includes an end cap mounted thereto. The end cap includes an opening through which the second piston rod extends. A gap is defined between the second piston rod and an inner periphery defining the opening of the end cap for supplying ambient air into the fourth chamber section during an outward stroke of the handle away from the head for low volume/high pressure inflation.

The outlet passage in the head includes a one-way valve mounted in the passage such that air is only flowable from the first chamber section to the outlet passage.

The first piston includes a one-way air inlet means arranged thereon such that air is only flowable from the second chamber section to the first chamber section when the handle is in its inward stroke for high volume/low pressure inflation. In a preferred embodiment of the invention, the first piston includes an annular groove defined in an outer periphery thereof. The annular groove includes a first end edge and a second end edge. An O-ring is mounted in the annular groove and so arranged that an air path is defined to allow air to flow from the second chamber section to the first chamber section when the O-ring abuts against the first end edge of the annular groove as a result of the outward stroke of the handle away from the head and that the air path is blocked when the O-ring abuts against the second end edge of the annular groove as a result of an inward stroke of the handle toward the head.

The second piston includes a one-way air inlet means arranged thereon such that air is only flowable from the fourth chamber section to the third chamber section when the handle is in its inward stroke for low volume/high pressure inflation. In a preferred embodiment of the invention, the second piston includes an annular groove defined in an outer periphery thereof. The annular groove includes a first end edge and a second end edge. An O-ring is mounted in the annular groove and so arranged that an air path is defined to allow air to flow from the fourth chamber section to the third chamber section when the O-ring abuts against the first end edge of the annular groove as a result of the outward stroke of the handle away from the head and that the air path is blocked when the O-ring abuts against the second end edge of the annular groove as a result of an inward stroke of the handle toward the head.

The second end of the first piston rod includes an outer threading and the handle includes an inner threading for releasably engaging with the inner threading of the first piston rod for high volume/low pressure inflation.

The first end of the cylinder includes an inner threading and the second end of the first piston rod includes an outer threading for releasably engaging with the inner threading of the cylinder for low volume/high pressure inflation.

Thus, a reliable dual-mode manual air pump is provided, and operation therefor is simple.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
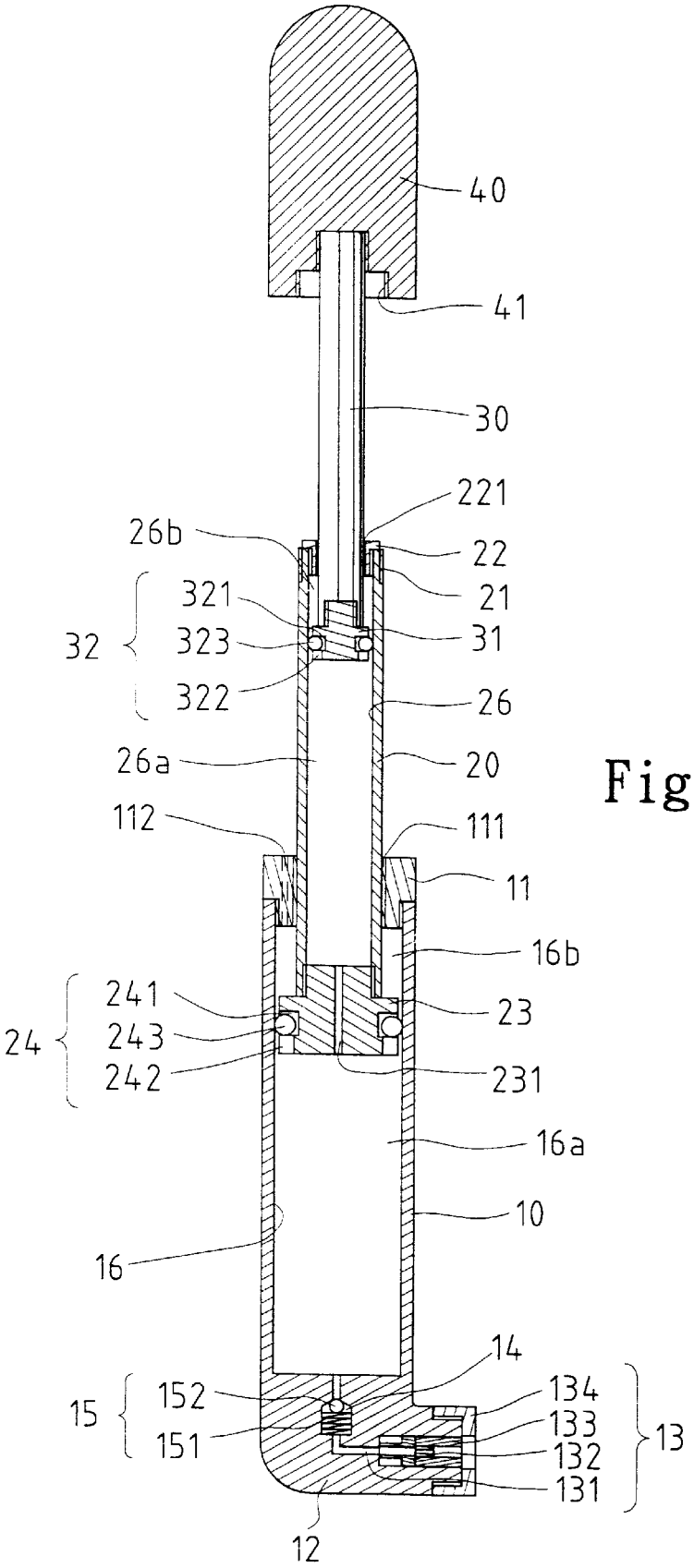
FIG. 1 is a sectional view of a manual air pump in accordance with the present invention.

Referring to FIG. 1, a manual air pump in accordance with the present invention generally comprises a cylinder 10 including a first chamber 16 therein. An end cap 11 is provided to seal an open end of the first chamber 16 and includes an opening 111 and an air inlet 112 that communicates the first chamber 16 with outside. The other end of the first chamber 16 is sealed by a head 12. The head 12 includes an outlet passage 131 communicated with the first chamber 16 for supplying air to an object to be inflated under control of an inflation valve means 13. In this embodiment, a nozzle 132 and a nozzle plug 133 are mounted in the main passage 131, and an end cap 134 is provided to secure the nozzle 132 and nozzle plug 133 in place. A one-way valve 15 (including an elastic member 151 and a ball 152) is mounted in an enlarged section 14 of the outlet passage 131 such that air is only flowable from the first chamber 16 to the main passage 131.

The manual air pump further includes a piston assembly that comprises a first piston rod 20 slidably extended through the opening 111 of the end cap 11. The first piston rod 20 is hollow and thus defines a second chamber 26 therein. The first piston rod 20 has a first end with a first piston 23 slidably received in the first chamber 16 and a second end. The first piston 23 separates the first chamber 16 into a first chamber section 16*a* adjacent to the head 12 and a second chamber section 16*b* distal to the head 12. The second end of the first piston rod 20 includes an end cap 22 mounted thereto, the end cap 22 having an opening 221, which will be described later.

The piston assembly further includes a second piston rod 30 having a first end with a second piston 31 slidably received in the second chamber 12 and a second end. The second piston 31 separates the second chamber 26 into a third chamber section 26*a* adjacent to the first piston 23 and a fourth chamber section 26*b* distal to the first piston 23. The second piston rod 30 is slidably extended through the opening 221 of the end cap 21, yet an annular gap (not labeled) is defined between the second piston rod 30 and an inner periphery defining the opening 221 of the end cap 22 to allow entrance of ambient air into the fourth chamber section 26*b*. A handle 40 is secured to the second end of the second piston rod 30 to move therewith.

Figure 4:
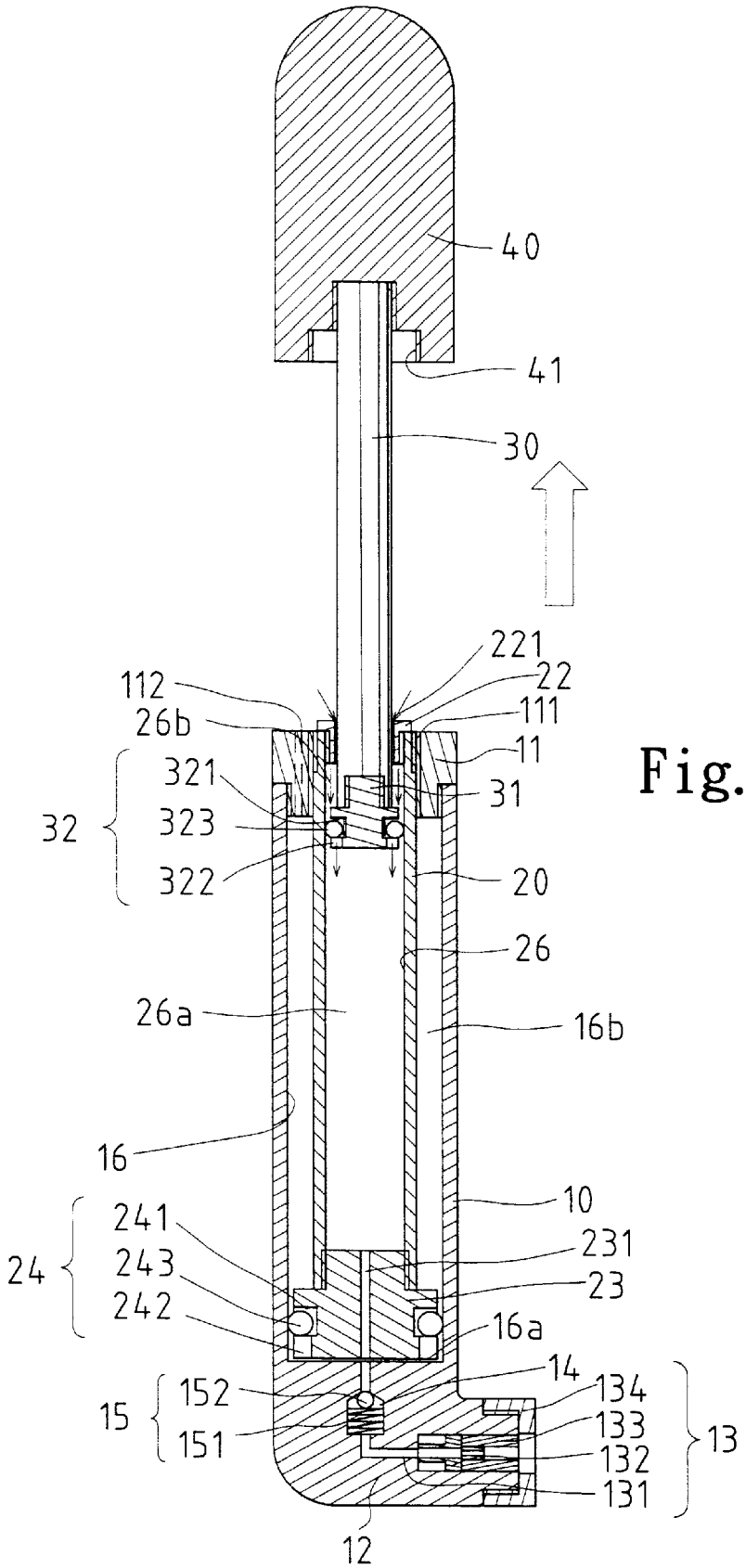
FIG. 4 is a sectional view similar to FIG. 1, wherein the handle of the pump is in an outward stroke for high-pressure pumping.

The first piston 23 has a connecting passage 231 that communicates the third chamber section 26*a* with the first chamber section 16*a*. A one-way air inlet means 24 is provided on the first piston 23 and includes an O-ring 243 mounted in an annular groove 241 defined in an outer periphery thereof. The annular groove 241 including a notch 242 in an end edge (the lower one in FIG. 1) thereof adjacent to the first chamber section 16*a*. The O-ring 243 and the annular groove 241 are so arranged that an air path (not labeled) is defined to allow air to flow from the second chamber section 16*b* to the first chamber section 16*a* when the O-ring 243 abuts against the lower end edge of the annular groove 241 and that the air path is blocked (i.e., the first chamber section 16*a* is not communicated with the second chamber section 16*b* ) when the O-ring 243 abuts against the other end edge of the annular groove 241. The second piston 31 has a similar arrangement 32 including an O-ring 323 and an annular groove 321 with a notch 322. Example of such piston is shown in FIGS. 4 and 7 of U.S. Pat. No. 5,873,705 issued on Feb. 23, 1999, which is incorporated herein for reference.

Figure 2:
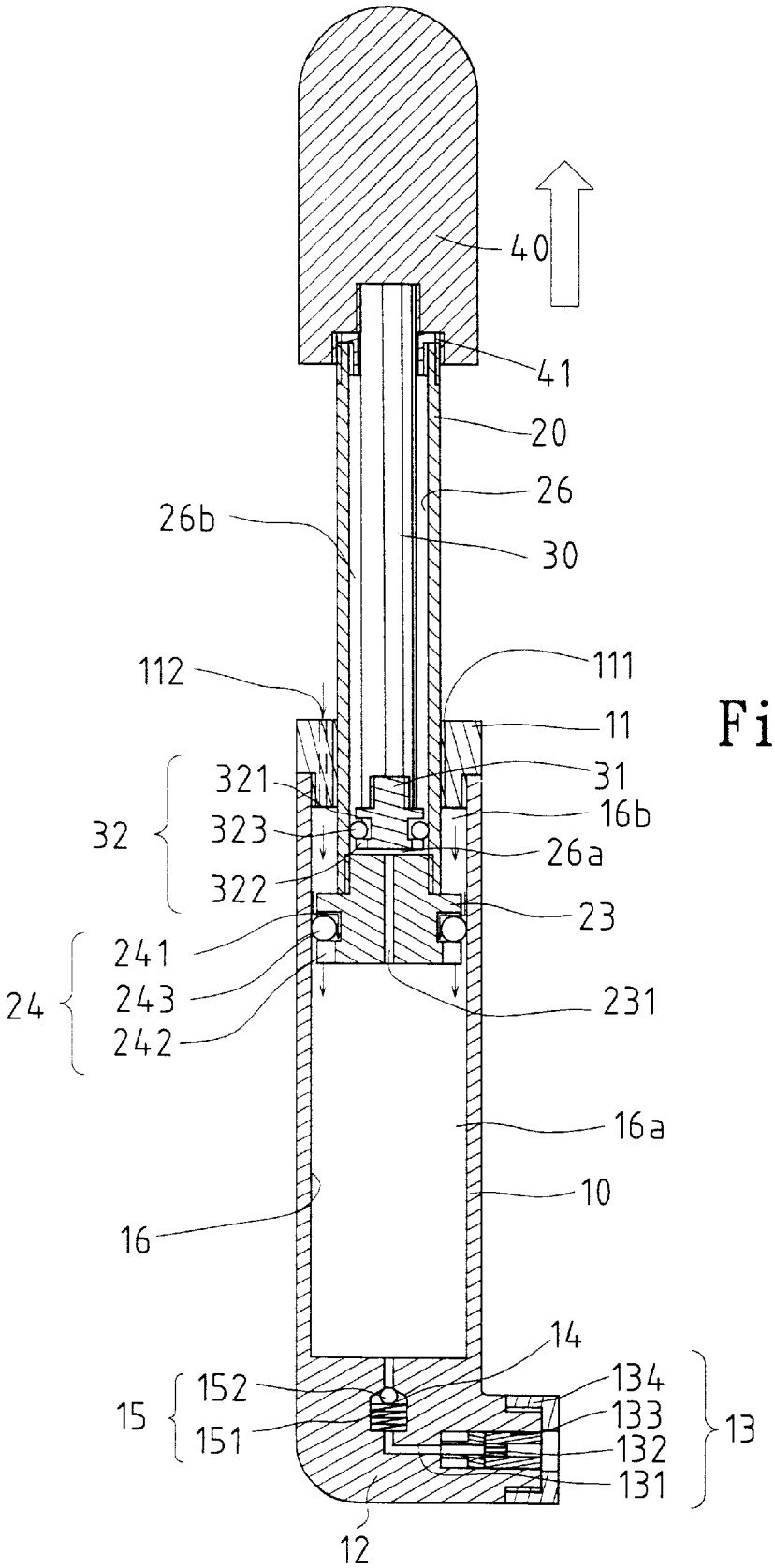
FIG. 2 is a sectional view similar to FIG. 1, wherein the handle of the pump is in an outward stroke for high-volume pumping.
Figure 3:
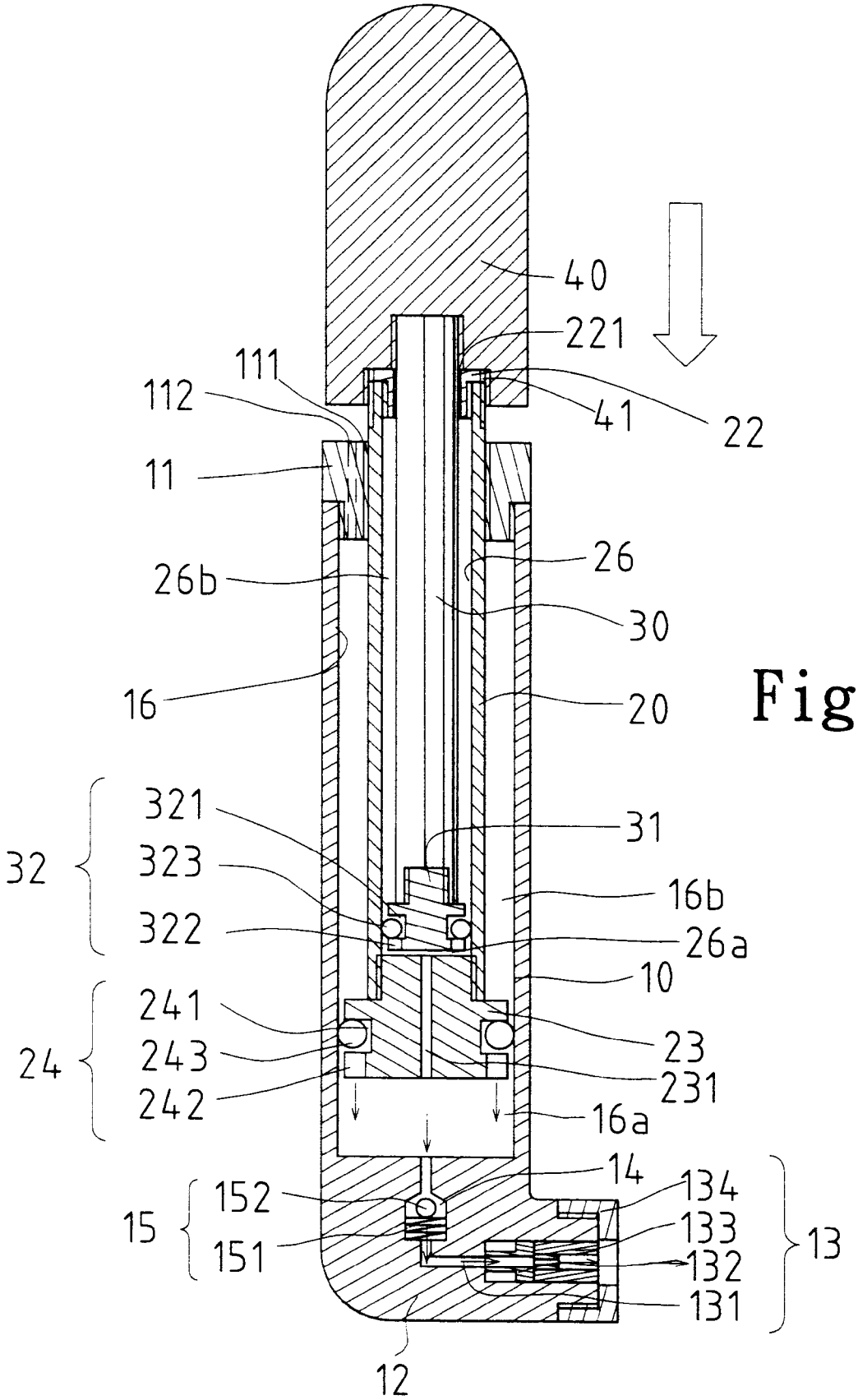
FIG. 3 is a sectional view similar to FIG. 1, wherein the handle of the pump is in an inward stroke for high-volume pumping.

In addition, the handle 40 includes an inner threading 41 and the outer end of the second piston rod 20 has an outer threading 21. In FIG. 2, the inner threading 41 of the handle 40 is engaged with the outer threading 21 of the second piston rod 20 to allow joint sliding movement of the first and second piston rods 20 and 30. During the outward stroke of the handle 40, O-ring 243 abuts against the lower edge of the annular groove 241 such that air is flowable from chamber section 1bb to chamber section 16*a*. In addition, vacuum in chamber section 16*a* as a result of a previous inward stroke of the handle 40 assists in intake of air. Thus, ambient air enters chamber section 16*a* during the outward stroke of the handle 40, best shown in FIG. 2. During the inward stroke of the handle 40, O-ring 243 abuts against the upper edge of the annular groove 241 such that air is not flowable from chamber section 16*b* to chamber section 16*a*. Thus, air in chamber section 16*a* is outputted via the outlet passage 131 in the head 12 during the inward stroke of the handle 40, best shown in FIG. 3. Accordingly, high volume/low pressure inflation is achieved. Ambient air enters chamber section 16*b* during the inward stroke of the handle 40 for subsequent outward stroke of the handle 40.

Figure 5:
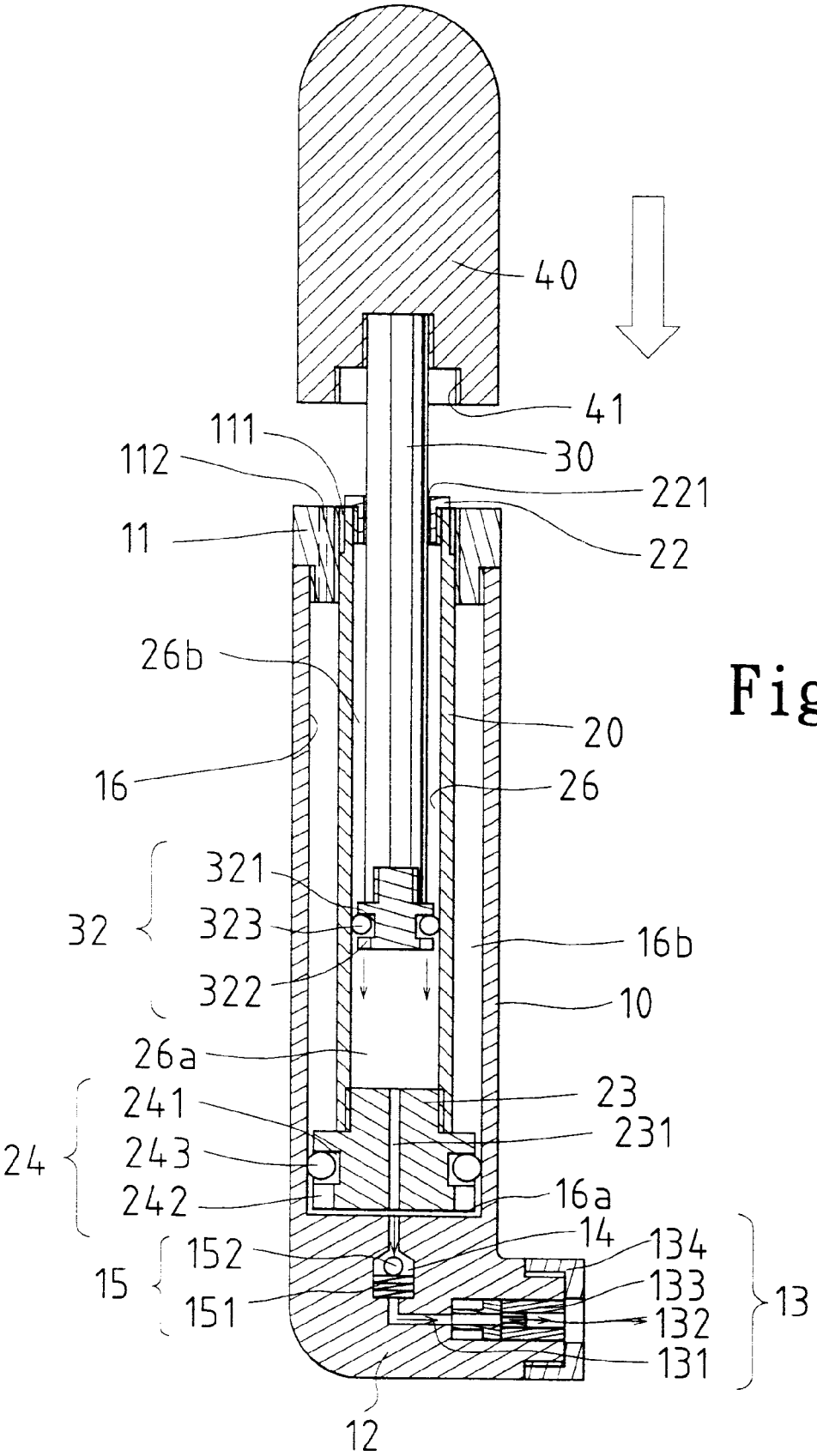
FIG. 5 is a sectional view similar to FIG. 1, wherein the handle of the pump is in an inward stroke for high-pressure pumping.

In FIG. 4, the inner threading 41 of the handle 40 is disengaged with the outer threading 21 of the second piston rod 20 while the first piston rod 20 is moved to its innermost position in which the connecting passage 231 is aligned with and thus communicated with the output passage 131. The opening 111 of the cylinder 10 may include inner threading for engaging with the outer threading 21 of the second piston rod 20 and thus retains the second piston rod 20 in place. During the outward stroke of the handle 40, O-ring 323 abuts against the lower edge of the annular groove 321 such that air is flowable from chamber section 26*b* to chamber section 26*a*. In addition, vacuum in chamber section 26*a* as a result of a previous inward stroke of the handle 40 assists in intake of air. Thus, ambient air enters chamber section 26*a* during the outward stroke of the handle 40. During the inward stroke of the handle 40, O-ring 323 abuts against the upper edge of the annular groove 321 such that air is not flowable from chamber section 26*b* to chamber section 26*a*. Thus, air in chamber section 26*a* is outputted via the main passage 131 in the head 12 during the inward stroke of the handle 40, best shown in FIG. 5. Thus, low volume/high pressure inflation is achieved. Ambient air enters chamber section 26*b* during the inward stroke of the handle 40 for subsequent outward stroke of the handle 40.

According to the above description, a reliable dual-mode manual air pump is provided, and operation therefor is simple and easy. Potential breakage of the thinner piston rod encountered during the use of conventional two-cylinder manual hand air pump is avoided.

Although the invention has been explained in relation to its preferred embodiment, it is to be understood that many other possible modifications and variations can be made without departing from the spirit and scope of the invention as hereinafter claimed.

What is claimed is:

1. A manual air pump comprising:

a cylinder comprising a first chamber and including a first end and a second end, a head provided to the second end of the cylinder, the head including an outlet passage communicated with the first chamber for supplying air to an object to be inflated, a piston assembly including:

a first piston rod having a first end with a first piston slidably received in the first chamber and a second end, the first piston separating the first chamber into a first chamber section adjacent to the head and a second chamber section distal to the head, the first piston rod defining a second chamber therein, a second piston rod having a first end with a second piston slidably received in the second chamber and a second end, the second piston separating the second chamber into a third chamber section adjacent to the first piston and a fourth chamber section distal to the first piston, and a handle secured to the second end of the second piston rod to move therewith, means for supplying ambient air into one of the second chamber section and the fourth chamber section during an outward stroke of the handle away from the head, means for releasably engaging the handle with the first piston rod;

means for communicating the third chamber section with the outlet passage when the first piston rod is retained in the second end of the first chamber;

whereby reciprocating movement of the handle causes high volume/low pressure inflation when the engaging means engage the handle with the first piston rod to allow joint sliding movement of the first piston rod and the second piston rod, and reciprocating movement of the handle causes low volume/high pressure inflation when the handle is disengaged from the first piston rod and the first piston rod is retained in the second end of the first chamber.

2. The manual air pump as claimed in claim 1, wherein the first end of the cylinder includes an end cap mounted thereto, the end cap including an opening through which the first piston rod extends, an air inlet being defined in the end cap for supplying ambient air into the second chamber section during an outward stroke of the handle away from the head for high volume/low pressure inflation.

3. The manual air pump as claimed in claim 2, wherein the opening of the end cap includes an inner threading and the second end of the second piston rod includes an outer threading for releasably engaging with the inner threading of the end cap for low volume/high pressure inflation.

4. The manual air pump as claimed in claim 1, wherein the first end of the second piston includes an end cap mounted thereto, the end cap including an opening through which the second piston rod extends, a gap being defined between the second piston rod and an inner periphery defining the opening of the end cap for supplying ambient air into the fourth chamber section during an outward stroke of the handle away from the head for low volume/high pressure inflation.

5. The manual air pump as claimed in claim 1, wherein the outlet passage in the head includes a one-way valve mounted in the passage such that air is only flowable from the first chamber section to the outlet passage.

6. The manual air pump as claimed in claim 1, wherein the first piston includes a one-way air inlet means arranged thereon such that air is only flowable from the second chamber section to the first chamber section when the handle is in its inward stroke for high volume/low pressure inflation.

7. The manual air pump as claimed in claim 6, wherein the first piston includes an annular groove defined in an outer periphery thereof, the annular groove including a first end edge and a second end edge, an O-ring being mounted in the annular groove and so arranged that an air path is defined to allow air to flow from the second chamber section to the first chamber section when the O-ring abuts against the first end edge of the annular groove as a result of the outward stroke of the handle away from the head and that the air path is blocked when the O-ring abuts against the second end edge of the annular groove as a result of an inward stroke of the handle toward the head.

8. The manual air pump as claimed in claim 1, wherein the second piston includes a one-way air inlet means arranged thereon such that air is only flowable from the fourth chamber section to the third chamber section when the handle is in its inward stroke for low volume/high pressure inflation.

9. The manual air pump as claimed in claim 8, wherein the second piston includes an annular groove defined in an outer periphery thereof, the annular groove including a first end edge and a second end edge, an O-ring being mounted in the annular groove and so arranged that an air path is defined to allow air to flow from the fourth chamber section to the third chamber section when the O-ring abuts against the first end edge of the annular groove as a result of the outward stroke of the handle away from the head and that the air path is blocked when the O-ring abuts against the second end edge of the annular groove as a result of an inward stroke of the handle toward the head.

10. The manual air pump as claimed in claim 1, wherein the second end of the first piston rod includes an outer threading and the handle includes an inner threading for releasably engaging with the inner threading of the first piston rod for high volume/low pressure inflation.

11. The manual air pump as claimed in claim 1, wherein the first end of the cylinder includes an inner threading and the second end of the second piston rod includes an outer threading for releasably engaging with the inner threading of the cylinder for high volume/low pressure inflation.

* * * * *